United States Patent [19]

Wood

[11] Patent Number: 4,815,212

[45] Date of Patent: Mar. 28, 1989

[54] MULTIPLE LINE DRAWING INSTRUMENT

[76] Inventor: Ben Wood, 366 Riverview Dr., Auburn, Calif. 95603

[21] Appl. No.: 176,332

[22] Filed: Mar. 31, 1988

[51] Int. Cl.[4] ..... B43L 13/02

[52] U.S. Cl. ..... 33/41.4; 33/18.1

[58] Field of Search ..... 33/18.1, 41.4, 44.41.1

[56] References Cited

U.S. PATENT DOCUMENTS

| | | | |
|---|---|---|---|
| D. 116,018 | 8/1939 | Cathcard . | |
| 417,231 | 12/1889 | Cole . | |
| 891,692 | 6/1908 | Hayden . | |
| 1,093,606 | 4/1914 | Cooley . | |
| 1,191,725 | 7/1916 | Paulsen | 33/41.4 |
| 1,564,721 | 12/1925 | Tallon . | |
| 1,731,395 | 10/1929 | Radtke . | |
| 2,394,452 | 2/1946 | Howard . | |
| 2,744,329 | 5/1956 | Way et al. | 33/18.1 |
| 3,762,054 | 10/1973 | Ballard | 33/41.4 |

FOREIGN PATENT DOCUMENTS 897771 3/1909 France .

*Primary Examiner*—Harry N. Haroian

*Attorney, Agent, or Firm*—Norman B. Rainer

[57] ABSTRACT

An instrument for use in preparing an accident report concerning an automotive vehicle is constructed to draw four continuous lines in a manner simulating the paths of the wheels of the vehicle. The instrument has a housing which confines four independently spring-loaded leads in a rectangular array. The leads are slidably held by an alignment plate which is threadably connected to the top of the housing.

6 Claims, 2 Drawing Sheets

MULTIPLE LINE DRAWING INSTRUMENT

BACKGROUND OF THE INVENTION

This invention relates to a device for drawing lines, and more particularly concerns a device for drawing four continuous lines on paper or the like.

Various multiple line drawing instruments have earlier been disclosed, each being intended for a specific purpose. Such instruments usually have a number of fixed drawing means oriented in a manner to render a series of uniformly spaced parallel lines. Such drawing instruments are limited to marking lines on a planar surface. The fixed drawing means are generally incapable of marking on surfaces which are rough or curved because one or more of the fixed drawing means may leave the drawing surface due to imperfections or contours in the surface. In addition, the drawing means may experience wear at different rates, and may consequently have unequal lengths, thereby preventing simultaneous contact of all drawing means with the drawing surface.

Upon arrival at the scene of an automobile accident, a police officer or other investigator usually fills out an accident report explaining in detail the accident scene. As part of this report, the automobile's skid marks are drawn to scale on a diagram of the road. Such skid marks are made on the pavement simultaneously by the four tires of an automobile and may be straight, curved, or looped, yet derived from the fixed rectangular array of the tires. The skid marks are difficult for the officer or investigator to reproduce due to the complicated geometry of the marks and the inability of the officer to maintain the constant rectangular juxtaposition of the four points that generate the skid marks on the accident report.

It is accordingly an object of the present invention to provide a line drawing instrument having four drawing means juxtapositioned in a rectangular array.

It is another object of the present invention to provide a multiple line drawing instrument capable of drawing continuous lines on imperfect planes and other surfaces.

It is yet another object of the present invention to provide a multiple line drawing instrument of the aforesaid type having replacable drawing means.

It is a further object of this invention to provide a line drawing instrument of the aforesaid nature of simple construction, easy to use, and amenable to low cost manufacture.

SUMMARY OF THE INVENTION

The above and other beneficial objects and advantages are accomplished in accordance with the present invention by a multiple line drawing instrument comprised of:

(a) an alignment plate having upper and lower surfaces, four cylindrical bores disposed perpendicularly between said upper and lower surfaces, the centers of said bores located in a rectangular array, and threaded retaining means centrally associated with said upper surface, (b) a housing having a downwardly directed opening that receives said alignment plate, enabling sliding movement of said plate into said housing, and a ceiling in spaced apart parallel relationship to said opening, said ceiling having four alignment stubs extending downwardly into said housing in co-axial alignment with said bores, and a central channel in coaxial alignment with said retaining means, (c) drawing means slidably retained by each bore, said drawing means having an upper extremity disposed above said upper surface and a lower extremity disposed below said lower surface, (d) four identical helical springs, each having a top end centered upon a stub and in abutment with said ceiling, and a bottom end acting upon the upper extremity of a drawing means, and (e) elongated connecting means extending through said central channel and interactive with said threaded retaining means in a manner to draw said alignment plate into said housing against the urging of said springs, whereby, (f) each drawing means is capable of independent vertical movement, thereby assuring that all four drawing means are in contact with a surface being drawn upon.

In preferred embodiments of the invention, the drawing means is a cylindrical pencil lead, and a gripping collar is interposed between the bottom end of each spring and the upper extremity of the associated pencil lead. The gripping collar, which may be fabricated of a resilient material, facilitates frictional retention of the pencil lead. An abutment shoulder may be disposed within the housing to establish the upper limit of travel of the alignment plate into the housing.

The housing is preferably of monolithic construction, as may be fabricated of plastic by injection molding, in which case, the abutment shoulder and alignment stubs are incorporated into the integral structure. The connecting means is preferably a threaded bolt having a head displaced atop the housing in abutment with said ceiling.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
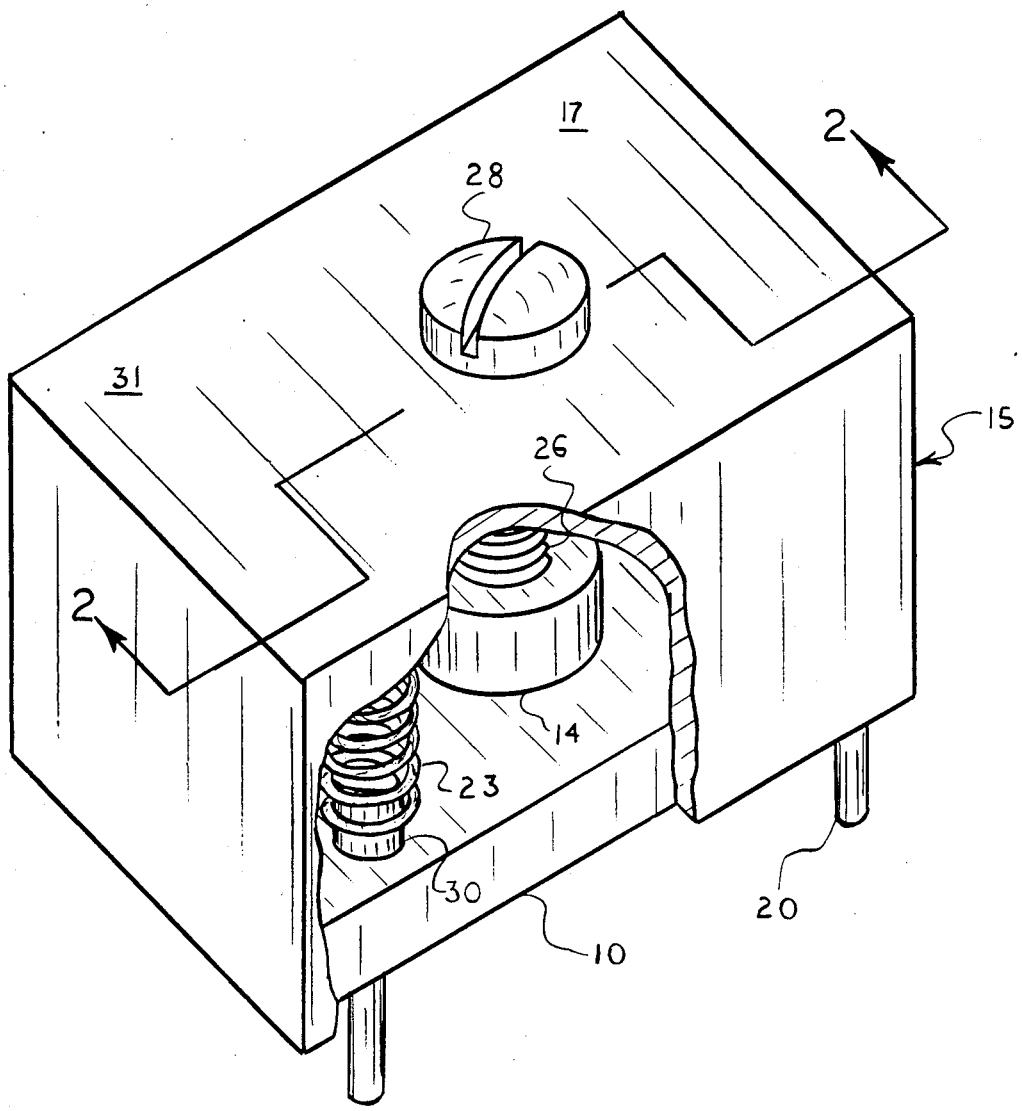
FIG. 1 is a perspective view of an embodiment of the drawing instrument of the present invention with portions broken away to reveal interior detail.
Figure 2:
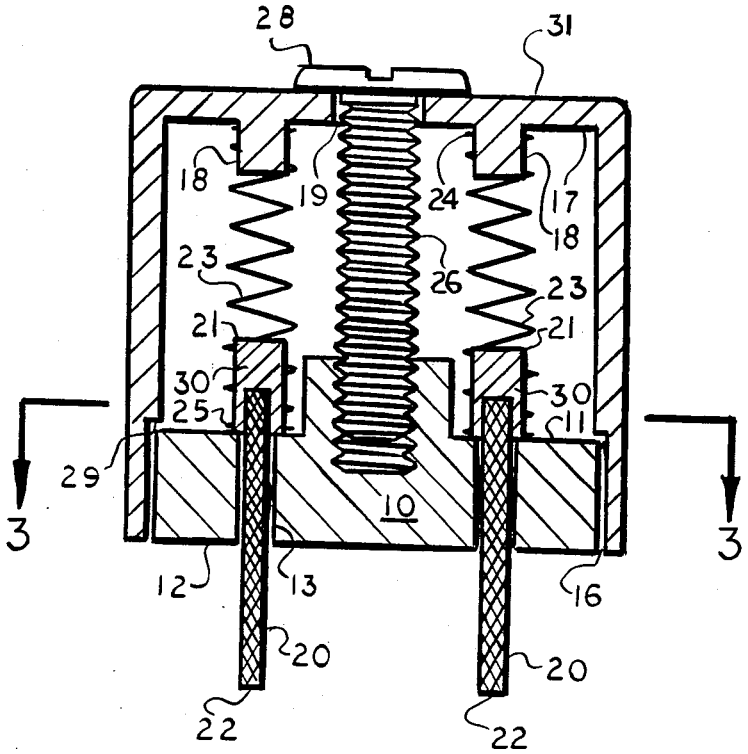
FIG. 2 is a sectional side view taken upon the line 2—2 of FIG. 1.
Figure 3:
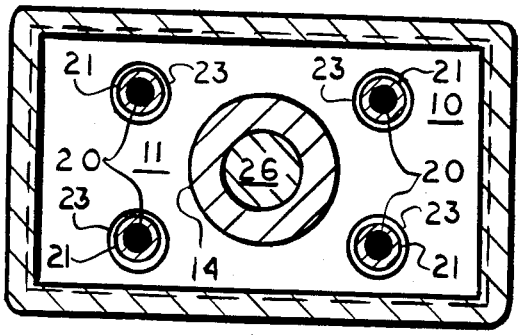
FIG. 3 is a sectional view taken upon the line 3—3 of FIG. 2.

Referring to FIGS. 1-3, an embodiment of the drawing instrument of the present invention is shown comprised of a rectangular alignment plate 10 having upper and lower surfaces 11 and 12, respectively. Four cylindrical bores 13 are disposed perpendicularly between said upper and lower surfaces 11 and 12. The centers of the bores are located in a rectangular array centered upon threaded retaining means in the form of threaded insert 14 centrally positioned upon upper surface 11. Housing 15, a monolithic structure fabricated of plastic, has a downwardly directed opening 16 that receives alignment plate 10 in close fitting relationship, thereby enabling sliding movement of the plate into the housing. Ceiling 17 is disposed in spaced apart parallel relationship to opening 16. The ceiling has four alignment stubs or pins 18 as continuous integral extensions to the ceiling extending downwardly into housing 15 in co-axial alignment with bores 13, and a central channel 19 in coaxial alignment with retaining means 14. Drawing means in the form of pencil leads 20 are slidably retained by each bore 13 and have an upper extremity 21 disposed above upper surface 11 and a lower extremity 22 disposed below lower surface 12. In alternative embodiments, the drawing means may be ball-tipped ink cylinders, or on a larger scale version, felt tipped markers or chalk may be used.

Four identical helical springs 23 are disposed within housing 15, each having a top end 24 centered upon a pin 18 and in abutment with ceiling 17, and a bottom end 25 acting upon upper extremity 21 of a pencil lead 20. A gripping collar 30 of a resilient material and held by each spring has a downwardly directed opening which permits removeable insertion of the upper extremities of the leads. Elongated connecting means in the form of threaded bolt 26 extends through central channel 19. A flat head 28 on said bolt abuts the upper surface 31 of ceiling 17. Bolt 26 interacts with threaded insert 14 in a manner to draw alignment plate 10 into said housing against the urging of said springs. The alignment plate is secured in an uppermost position by abutment shoulders 29 fashioned within the housing structure. Each pencil lead 20 is capable of independent vertical movement, thereby assuring that all four pencil leads 20 are in contact with a surface being drawn upon.

Downward pressure exterted upon the drawing instrument causes the pencil leads to slide vertically within the bores 13 while being pressed against the drawing surface. The pencil leads 20 are thereby automatically adjusted to maintain all four lower extremities 22 in contact with the drawing surface. The pencil leads may experience wear at different rates and be of differing lengths, yet still four continuous lines will be drawn simultaneously. The housing 15 may be removed for servicing or to change pencil leads by removing threaded bolt 26.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A multiple line drawing instrument comprised of:

(a) an alignment plate having upper and lower surfaces, four cylindrical bores disposed perpendicularly between said upper and lower surfaces, the centers of said bores located in a rectangular array, and threaded retaining means centrally associated with said upper surface, (b) a housing having a downwardly directed opening that receives said alignment plate, enabling sliding movement of said plate into said housing, and a ceiling in spaced apart parallel relationship to said opening, said ceiling having four alignment stubs extending downwardly into said housing in coaxial alignment with said bores, and a central channel in coaxial alignment with said retaining means, (c) drawing means slidably retained by each bore, said drawing means having an upper extremity disposed above said upper surface and a lower extremity disposed below said lower surface, (d) four identical helical springs, each having a top end centered upon a stub and in abutment with said ceiling, and a bottom end acting upon the upper extremity of a drawing means, and (e) elongated connecting means extending through said central channel and interactive with said threaded retaining means in a manner to draw said alignment plate into said housing against the urging of said springs, whereby, (f) each drawing means is capable of independent vertical movement, thereby assuring that all four drawing means are in contact with a surface being drawn upon.

2. The instrument of claim 1 wherein the drawing means is a cylindrical pencil lead, and a gripping collar is interposed between the bottom end of each spring and the upper extremity of the associated pencil lead.

3. The instrument of claim 2 wherein said gripping collar is fabricated of a resilient material which facilitates frictional retention of the pencil lead.

4. The instrument of claim 1 wherein an abutment shoulder is disposed within said housing to establish the upper limit of travel of the alignment plate into the housing.

5. The instrument of claim 1 wherein said housing is of monolithic construction, being fabricated of plastic by injection molding, said abutment shoulder and alignment stubs being integrally incorporated into said monolithic construction.

6. The instrument of claim 1 wherein said connecting means is a threaded bolt having a head disposed atop the housing in abutment with said ceiling.

* * * * *